US008443478B2

(12) United States Patent
West et al.

(10) Patent No.: US 8,443,478 B2
(45) Date of Patent: May 21, 2013

(54) SURFACE DEBRIS REMOVAL APPARATUS

(75) Inventors: James A. West, Bristol (GB); Mark D. Teucher, Bristol (GB); Christopher T. Elsworthy, Bristol (GB)

(73) Assignee: Dovia International Limited, Wong Chuk Hang (HK)

( * ) Notice: Subject to any disclaimer, the term of this patent is extended or adjusted under 35 U.S.C. 154(b) by 537 days.

(21) Appl. No.: 12/690,675

(22) Filed: Jan. 20, 2010

(65) Prior Publication Data

US 2010/0115719 A1 May 13, 2010

Related U.S. Application Data

(63) Continuation-in-part of application No. PCT/CN2007/002345, filed on Aug. 6, 2007.

(51) Int. Cl.
*A47L 11/24* (2006.01)

(52) U.S. Cl.
USPC ..... 15/41.1; 15/50.3; 15/52.1

(58) Field of Classification Search
USPC ..... 15/41.1, 42, 49.1, 50.3, 52.1
See application file for complete search history.

(56) References Cited

U.S. PATENT DOCUMENTS

| | | | | |
|---|---|---|---|---|
| 2,403,105 | A * | 7/1946 | Linderoth | 15/41.1 |
| 6,994,740 | B2 * | 2/2006 | Gammack et al. | 55/343 |
| 7,113,847 | B2 * | 9/2006 | Chmura et al. | 700/245 |
| 7,341,611 | B2 * | 3/2008 | Greene et al. | 55/337 |
| 7,676,877 | B2 * | 3/2010 | Policicchio et al. | 15/41.1 |
| RE42,155 | E * | 2/2011 | Ragner | 15/340.2 |
| 2004/0074038 | A1 * | 4/2004 | Im et al. | 15/319 |
| 2005/0005377 | A1 | 1/2005 | Kaleta | |
| 2005/0011028 | A1 | 1/2005 | Chow | |
| 2005/0268410 | A1 * | 12/2005 | Kaleta | 15/42 |
| 2007/0289085 | A1 | 12/2007 | Yoo | |

FOREIGN PATENT DOCUMENTS

| | | | |
|---|---|---|---|
| CN | 1895152 | A | 1/2007 |
| DE | 3434209 | A1 | 3/1986 |
| GB | 2434743 | A | 8/2007 |

* cited by examiner

*Primary Examiner* — Shay Karls
(74) *Attorney, Agent, or Firm* — Lucas & Mercanti LLP; Robert P. Michal

(57) ABSTRACT

This invention relates to a mechanism for use in a device that comprises a system for collecting dirt and debris from a variety of floor and upholstery surfaces. In particular the mechanism lifts and directs unwanted debris particles to a waste reservoir for the purpose of cleaning and grooming floor surfaces. The debris collection mechanism can be, but is not limited to its use in a handle operated cordless motorized floor sweeper to collect and gather unwanted debris and dust. The device includes a head unit that incorporates two easily removable elongate cylindrical rotating cleaning bars that are driven such that they contra rotate, and are positioned close to one another at the forward region of the head unit. A removable debris reservoir, removable rechargeable power source and handle incorporating a device operation switch are also included.

30 Claims, 4 Drawing Sheets

SURFACE DEBRIS REMOVAL APPARATUS

CROSS-REFERENCE TO RELATED APPLICATION

This application is a continuation-in-part (CIP) of PCT International Application Serial No. PCT/CN2007/002345 filed Aug. 6, 2007, the contents of which are incorporated herein by reference.

THE TECHNICAL FIELD

The invention relates to a surface cleaning apparatus intended as a motor assisted device that will be used to clean internal floor spaces and upholstery in houses and offices.

THE BACKGROUND ART

No similar apparatus was described before.

THE CONTENT OF INVENTION

The device of invention comprises a head unit that incorporates two elongate cylindrical rotating bristled cleaning bars that are driven such that they contra rotate and are positioned close to one another at the forward region of the head unit.

The head unit also contains electric motors and a drive system extending between the motors and the cleaning bars.

Each cleaning bar is driven by a separate motor. Alternatively one motor can be used to drive both cleaning bars.

The cleaning bars rotation is such that the forward most cleaning bristled bar rotates in the direction which would pull the device forwards along the surface being cleaned and the rearmost cleaning bristled bar rotates in the opposite direction to the forward one.

A fixed surface may be provided between the two cleaning bars inclined from the vertical and extending from the base of the product wrapping around part of the circumference of the rear most cleaning bar. This wall directs debris from both the front and rear cleaning bars rearwards to the debris collection reservoir.

A fixed surface inclined from the vertical may be provided between the rearmost cleaning bar and the debris reservoir.

The forward most rotating bristled cleaning bar may be driven from a given distance along its length and not from one end. For example, a toothed belt, 'V' belt or worm drive can be driven from an electric motor rotating a pulley or gear with splined shafts extending either side of its axis of rotation. The forward most cleaning bar may comprise two shorter bristled cleaning bars with splined holes in them to engage with the splined shafts of the drive pulley and provide rotational drive to each side of the front cleaning bar.

Each side of the front cleaning bar can be removed along its axis and out from the sides of the device for periodic cleaning and removal of entangled hair or debris. The opposite end of the front cleaning bar from the splined hole has a bearing and bearing cap assembled to it. The bearing cap has locating features that secure each cleaning bar to the head unit of the device. Removal of each side of the front cleaning bars can be made by rotating the bearing cap relative to the head unit of the product releasing it for removal along the axis of the cleaning bar. The rotation of the bearing cap for release is in a direction such that the direction of rotation of the front cleaning bar when in use tends to keep the bearing cap in the locked position.

Removal of the bearing cap to extract each side of the front cleaning bar can be performed by hand or alternatively it can have features that locate with either a custom removal tool or a common workshop tool. Alternatively the bearing caps can be detached from the head unit of the product by a method other than rotation.

Attached to the head unit is a steering handle unit that encloses a removable battery pack to power the device and operating switches/controls. Alternatively the electric drive motors can be mains or fuel cell powered. The removable battery pack can be recharged when attached to the device using a charging jack on the device or be recharged when removed from the device by cable attachment or in a charging dock.

The battery pack may come in a variety of package sizes dependent on the number of cells contained within the battery pack to alter the product's performance. All battery pack sizes share a common format for physical and electrical attachment to the device.

The device may incorporate a series of electronic settings to change the rotational velocities of each cleaning bar independently or coupled. For example hard floors and carpet may have different cleaning bar rotational velocities for optimal debris removal from the surface in question. Different settings can also be used for changing the product performance.

The tubular portion of the handle mechanism attached to the head unit of the device may incorporate an airflow passage through it to allow the addition of a vacuum to be attached to the handle tube for additional fine particle cleaning. The vacuum tube terminates in the head unit in a horizontal cavity between the two cleaning bars with access holes or slots for air flow to a vacuum unit. The action of the two rotating bristled cleaning bars causes debris particles to be dislodged from the surface being cleaned and propelled rearwards into the debris collection reservoir, dislodged fine particles such as dust are light and small enough to be entrained into the vacuum airflow path and taken to a separate debris reservoir as part of the vacuum unit on the handle mechanism. The vacuum and debris reservoir assembly mounted on the handle may incorporate the rechargeable battery pack, fuel cell or mains cord to power the overall device. The vacuum and debris reservoir assembly maybe removable and when separated from the handle of the main assembly be used independently to clean upholstery, curtains etc.

The handle mechanism comprises a pivoting arm attached to the head unit where the pivot is positioned between wheels or rollers at the front of the head unit and wheels or rollers at the rear, such that when the product is maneuvered during use there is no tendency for the leading edge of the product to dive into, or lift away from, the surface being cleaned. Attached to the pivoting arm is a rotating steering joint set at an angle from the longitudinal axis of the tubular portion of the handle assembled into it. When the upper portion of the handle is rotated about its axis the angled steering joint causes the lower portion and head unit of the product to rotate, providing a steering action.

The steering mechanism can incorporate a sprung locking strut that interacts with the rotating joint on the head and is driven from the pivoting angle joint. The angle at which the lock is activated can be changed by the design of the geometry and is not limited to a single lock position. For example when the handle is rotated fully forwards about the pivot on the base unit the sprung locking strut activates to retain the angled steering joint in its centre position. This steering lock mechanism allows easy and stable storage of the product's handle component in a pre-determined position.

Attached to the rear of the head unit is a removable debris collection reservoir that can be detached from the head unit by depressing a release button or other methods. The debris reservoir may have an automatic mechanical closing door system operated by removal of the debris reservoir from the head unit. The automatic closing door prevents spillage of collected debris when the user transfers it to a waste container. The debris reservoir release button may act as the debris reservoir door opening feature when it is removed from the head unit.

A safety feature either mechanical or an electrical switch can be employed to activate when the debris reservoir is removed to prevent the cleaning bars from rotating should the device be accidentally switched on.

The device may incorporate as part of the debris reservoir a mechanical or electric motor driven fan and filter assembly to create airflow from the forward portion of the head unit past the cleaning bars into the debris reservoir. This airflow will help entrain less dense particles into the debris reservoir improving fine particle cleaning performance.

A preferred embodiment of the invention will now be described with reference to the accompanying drawings in which:

THE BRIEF DESCRIPTION OF FIGURES

THE MODE OF CARRYING OUT THE INVENTION

Figure 1:
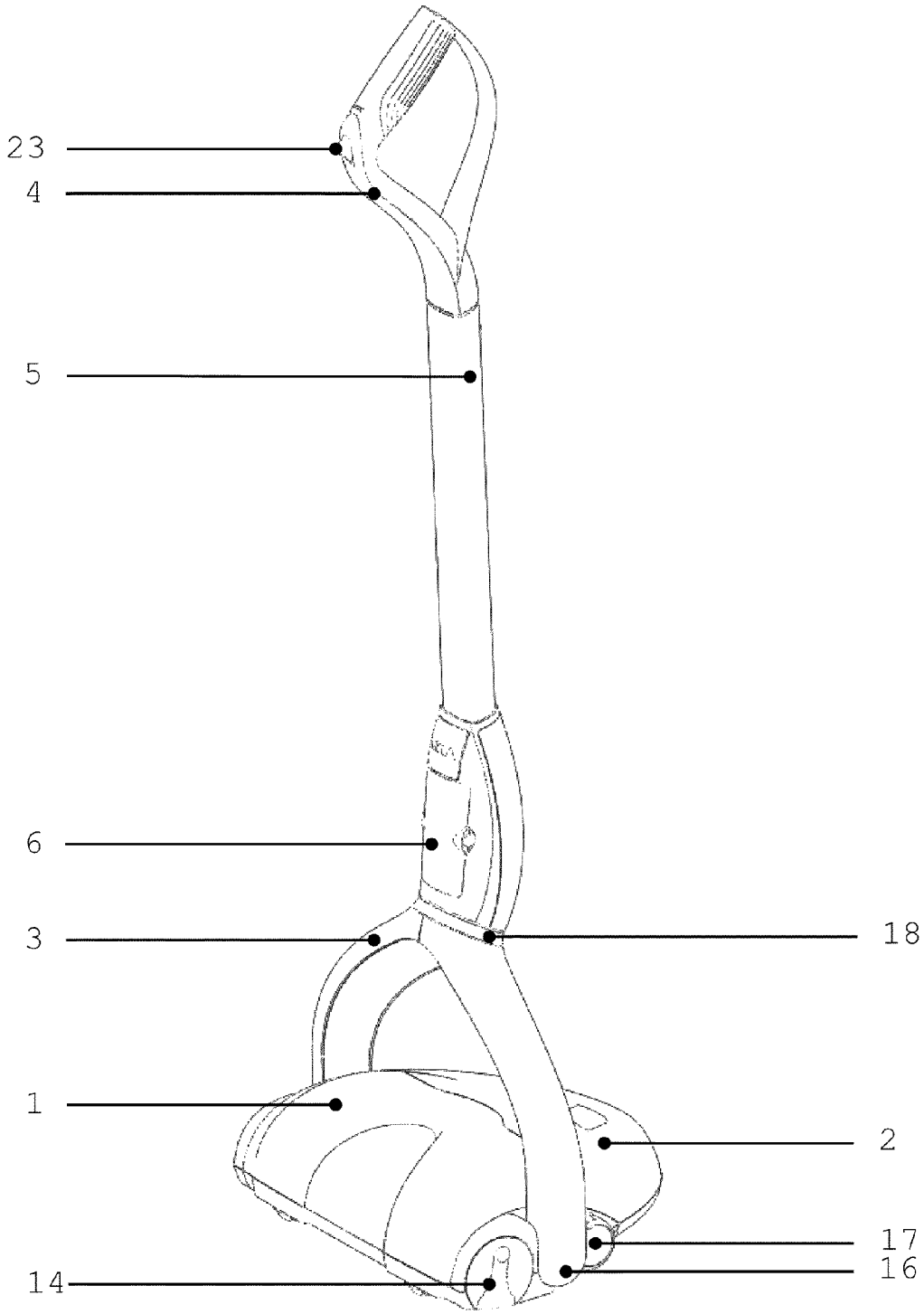
FIG. 1 is a perspective view of the surface cleaning apparatus as described in the present invention.

The surface cleaning apparatus shown in FIG. 1 comprises a head unit 1, a debris collection reservoir 2, a lower handle assembly 3 and upper handle assembly 4 suitably moulded from a plastics material. The tubular section 5 of the upper handle assembly is an aluminum extrusion or moulded from a plastics material. The head unit 1 contains electric motors and two elongate cylindrical rotating bristled cleaning bars driven such that they contra rotate.

Figure 2:
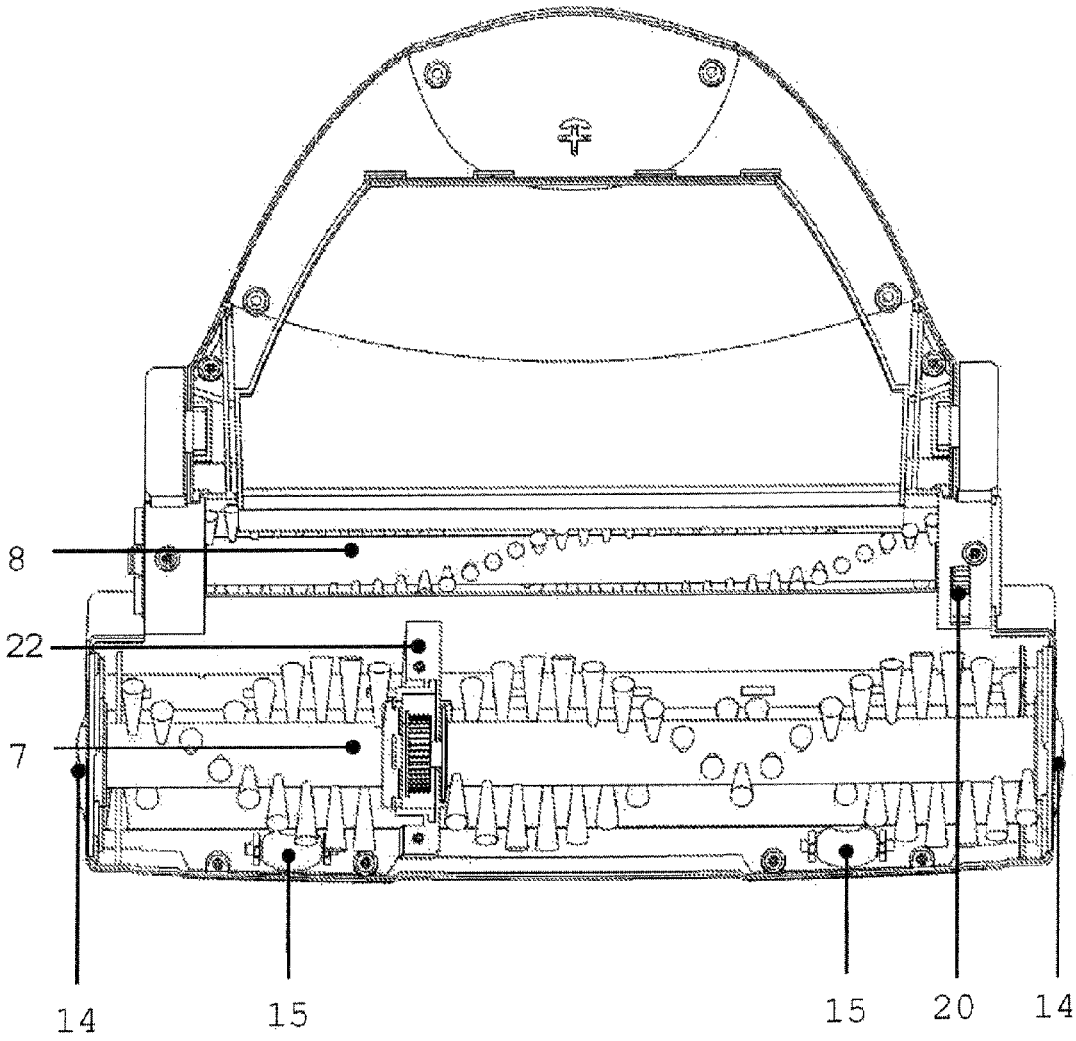
FIG. 2 is an top plan view of one embodiment of the head unit of the surface cleaning apparatus with the top cases removed from the head unit for clarity, as described in the present invention.
Figure 3:
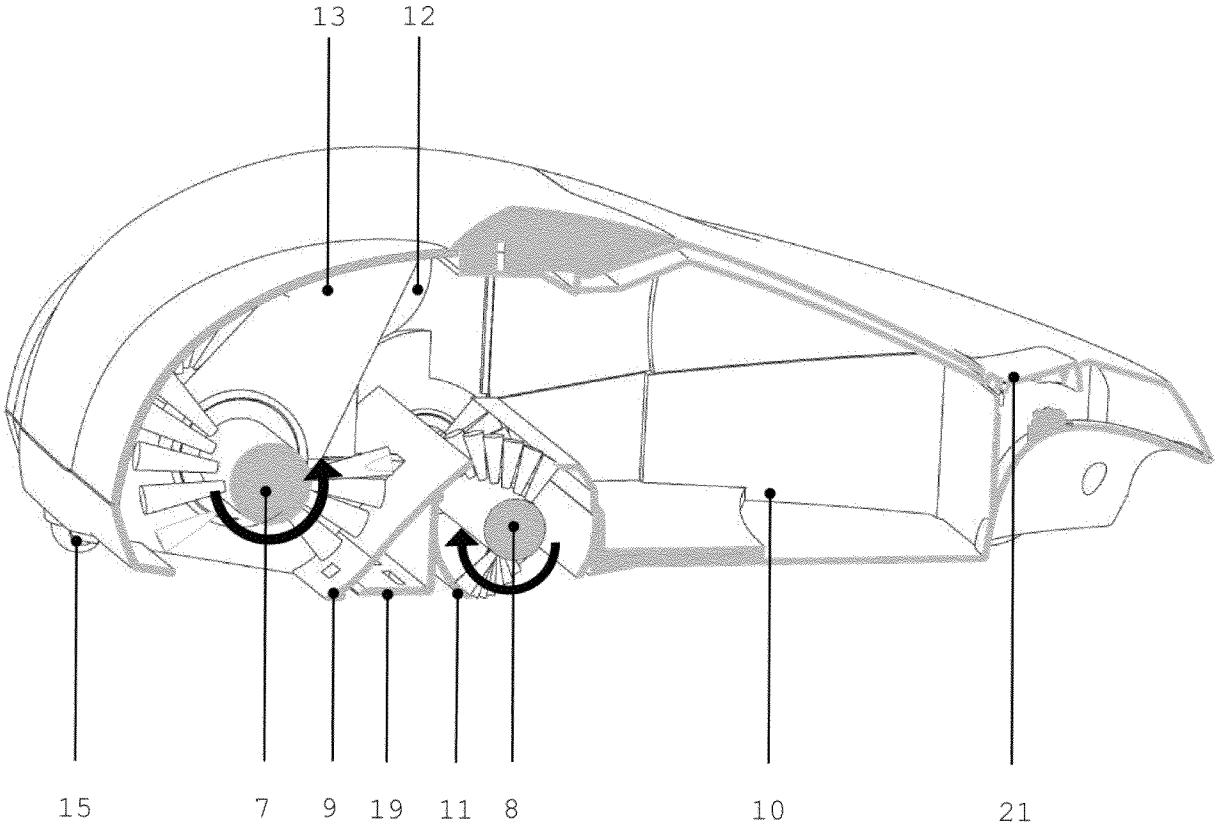
FIG. 3 is a perspective view partially in section of the head unit assembly of the surface cleaning apparatus shown in FIG. 2.

FIGS. 2 and 3 show the mechanical layout of the head unit. Cleaning bars 7 and 8 rotate in the direction of the curved arrows in FIG. 3 and are positioned in the head unit such that they contact the surface to be cleaned. Cleaning bar 7 rotates propelling debris and dust up the rearwards curved wall 9 into the debris collection reservoir 10. Cleaning bar 8 rotates in the opposite direction to cleaning bar 7 and propels debris and dust around the curved wall 11 and into the debris collection reservoir 10. The use of this dual contra rotating brush bar arrangement provides two sets or cleaning bars to pass over the surface being cleaned for each pass of the invention. When the invention is being propelled across the surface being cleaned in either the forwards or rearward direction one of the cleaning bars is rotating against the direction of travel, this action tends to lift carpet pile and increase the debris and dust collection from the surface being cleaned. The action of contra rotating cleaning bars orientated close to one another creates an entrained airflow directed into the debris collection reservoir 10 of the product. The entrained airflow into the product is beneficial when using the product on smooth hard surfaces allowing fine dust particles and hair to be propelled into the debris collection reservoir and not to be blown away from the unit.

Drive motors 12 are positioned above the debris path to the debris collection reservoir preventing clogging of the motors or drive mechanism. The front cleaning bar 7 is driven from a given distance along its length via a toothed pulley with splined shafts protruding from each side of it, a toothed belt connects to the motor and is contained in a shroud 13 moulded from a plastics material. The cleaning bar 7 comprises two shorter cleaning bars with splined holes in each to engage with the splined shafts of the drive pulley and provide rotational drive to each side of the cleaning bar. Removal of each side of cleaning bar 7 for periodic cleaning and removal of entangles hair or debris is performed by unlocking a bearing cap 14 at each end of the head unit. Each side of the cleaning bar 7 can then be removed along its axis. Removal of the bearing caps 14 can be made by rotating or unclipping them either by hand or using a removal tool. This arrangement of a split cleaning bar enables the cleaning bristles to be in close proximity to each side of the head unit thus providing the device to clean close to walls, skirting boards and furniture.

Drive to the rear cleaning bar 8 is via a toothed pulley 20 that incorporates a protruding splined drive shaft from one side to provide rotational drive to the rear cleaning bar 8. Removal of the rear cleaning bar 8 for periodic cleaning and removal of entangles hair or debris is achieved by unclipping the sole plate 19, then tilting and extracting the cleaning bar from the splined drive shaft.

The cleaning bars 7 and 8 are arranged such that the drive systems powering them 22 and 20, respectively, do not line-up front to back along the product, this ensures that the non bristled portions of the cleaning bars 7 and 8 where the drive systems are prevent any missed areas on the surface being cleaned.

The lower handle assembly pivots on the head unit about its connection point 16, rollers 15 are positioned ahead of the handle pivot point 16 and wheels 17, are positioned behind the handle pivot point. This arrangement of handle pivot 16, wheels 17, and rollers 15 prevents any tendency for the leading edge of the head unit to dive into, or lift away from the surface being cleaned.

Part of the lower handle assembly is a rotating steering joint 18 set at an angle from the longitudinal axis of the tubular portion of the handle 5 assembled into it. When the upper portion of the handle 4 is rotated about its axis the angled steering joint causes the lower portion 3 and head unit 1 of the product to twist, providing a steering action.

The handle mechanism 16 and rotating joint 18 attached to the head unit 1 of the device may incorporate an airflow passage through them to allow the addition of a vacuum and debris reservoir assembly (not shown) to be attached to the handle tube 5 for additional fine particle cleaning. The vacuum tube terminates in the head unit 1 in a horizontal cavity between the two cleaning bars 7 and 8, e.g., in a wall structure including curved walls 9 and 11 and sole plate 19, with access holes or slots for air flow to a vacuum unit. A vacuum and debris reservoir assembly (not shown) mounted on the handle may incorporate the rechargeable battery pack, fuel cell or corded main attachment to power the overall device. The vacuum and debris reserve reservoir assembly maybe removable from the handle and when separated from the handle of the main assembly be used independently to clean upholstery, curtains etc.

Figure 4:
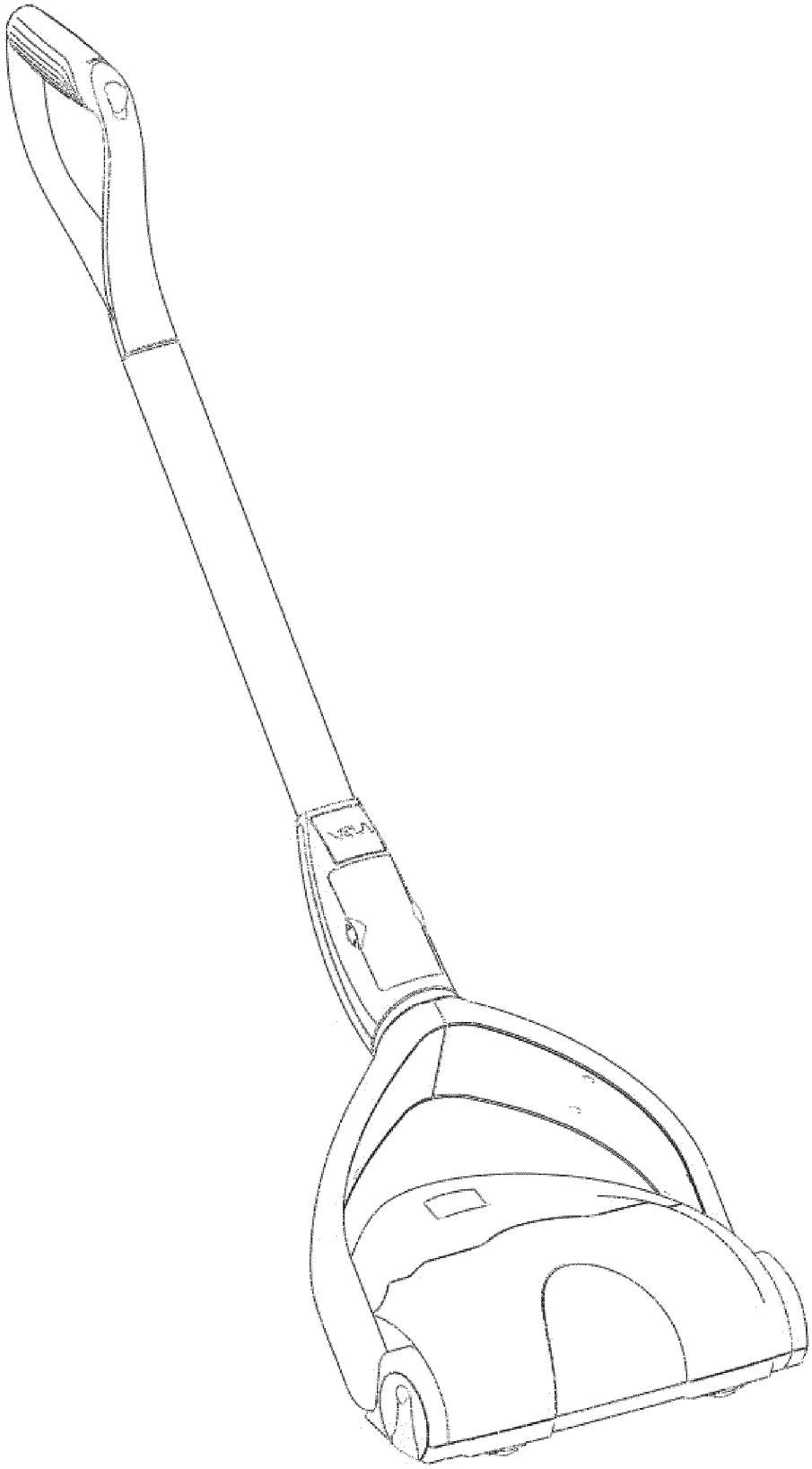
FIG. 4 is a perspective view of the surface cleaning apparatus with the handle assembly is in a tilted position as described in FIG. 1.

The steering mechanism can incorporate a sprung locking strut that interacts with the rotating joint 16 on the head and is driven from the pivoting angle joint 18. The angle at which the lock is activated can be changed by the design of the geometry and is not limited to a single lock position. For example when the handle is rotated fully forwards about the pivot on the base unit, as shown in FIG. 1 the sprung locking strut activates to restrain the angled steering joint 18 in its centre position. When the handle is tilted rearwards when using the product as shown in FIG. 4 the steering lock is disengaged allowing the steering joint 18 to rotate freely between its end stops.

Incorporated into the lower handle housing is a removable rechargeable battery pack 6, that can be recharged when it is attached to the product and connected to a mains power supply (not shown) or when the battery pack 6 is removed from the product and connected to a mains power supply (not shown). As an alternative to the rechargeable battery pack the device could be mains or fuel cell powered.

A switch 23 is mounted to the upper handle 4 to operate the device. This switch can be used to turn the product on and off and also change settings for different surface cleaning situations e.g. hard floors and carpet. The electrical cables travel from switch 23 down through the handle tube 5 to connect to the power source 6, through the rotation joint 18 and into the lower handle 16 before exiting into the drive motors mounted in the head unit 1.

The removable debris collection reservoir 2 can be detached from the head unit by depressing a release button 21. The debris reservoir 2 may have an automatic mechanical closing door system (not shown) operated by removal of the debris reservoir from the head unit to prevent spillage of collected debris. Alternatively the debris reservoir release button 21 may act as the debris reservoir door opening/closing feature when it is removed from the head unit. The debris reservoir 2 may incorporate a safety cut-out switch either electrical or mechanical to prevent the cleaning bars being activated when the debris reservoir is removed.

The invention claimed is:

1. A motor assisted surface cleaning device, comprising:

a head cleaning unit having a forward end and a rear end, the head cleaning unit comprising first and second elongate, rotatable bristled cleaning bars positioned in close proximity to one another and that each rotate about a respective axis, the bristled cleaning bars being configured to rotate in opposite directions, the first cleaning bar being more proximate the forward end of the head cleaning unit than the second cleaning bar, a debris collection reservoir attached to the rear end of the head cleaning unit and situated partly rearward of the first and second cleaning bars, and a handle attached to the head cleaning unit, the head cleaning unit further comprising a wall structure arranged between the first and second cleaning bars, the wall structure including a first wall portion rearwardly inclined from a vertical line such that an upper end of the rearwardly inclined first wall portion is more proximate the rear end of the head cleaning unit than a lower end, the wall structure also including a second wall portion that extends around part of a circumference of the second cleaning bar, the first wall portion being configured to cause debris propelled by the first cleaning bar to be directed in a rearward direction toward the debris collection reservoir, the second wall portion being configured to cause debris propelled by the second cleaning bar to be directed to the debris collection reservoir.

2. A device according to claim 1, wherein the debris collection reservoir is removable from the head cleaning unit.

3. A device according to claim 2, wherein the debris collection reservoir has a door system configured to be opened via a push button for emptying.

4. A device according to claim 3, wherein the push button releases the debris collection reservoir from the head cleaning unit.

5. A device according to claim 2, further comprising a cut-out switch configured to prevent the first and second cleaning bars from rotating when the debris collection reservoir is removed from the head cleaning unit.

6. A device according to claim 1, further comprising a drive system that drives the first cleaning bar, the drive system being configured to drive the first cleaning bar at a location between axial ends of the first cleaning bar and thus not from either axial end.

7. A device according to claim 1, wherein the first cleaning bar comprises two parts, each of the two parts of the first cleaning bar being removable from the head cleaning unit outwardly along the axis of the first cleaning bar.

8. A device according to claim 7, further comprising two bearing caps each having an unlocked position and configured such that when in the unlocked position, a respective one of the parts of the first cleaning bar is removable along the axis of the first cleaning bar.

9. A device according to claim 1, wherein the first cleaning bar is configured to be removable from the head cleaning unit by hand without the use of tools.

10. A device according to claim 9, wherein the second cleaning bar is configured to be removable from the head cleaning unit by hand without the use of tools.

11. A device according to claim 1, further comprising a first drive system that drives the first cleaning bar and a second drive system that drives the second cleaning bar and is not aligned to the first drive system.

12. A device according to claim 1, wherein the first and second cleaning bars are configured to be operably driven by at least one motor.

13. A device according to claim 12, wherein the at least one motor is main powered.

14. A device according to claim 12, wherein the at least one motor is powered by a fuel cell.

15. A device according to claim 12, further comprising a rechargeable battery pack retained by the handle and to which the at least one motor is connectable.

16. A device according to claim 15, wherein the battery pack is configured to remain on the handle for recharging.

17. A device according to claim 15, wherein the battery pack is configured to be removable from the handle for recharging.

18. A device according to claim 15, wherein the handle is configured to receive different size battery packs.

19. A device according to claim 18, wherein each of the battery packs is removable and attachable to a wall or floor mounted docking station for recharging.

20. A device according to claim 1, wherein the device is configured to be attachable to a wall or floor mounted docking station for storage or battery charging.

21. A device according to claim 1, wherein the first and second cleaning bars are configured to have variable speeds of rotation.

22. A device according to claim 21, wherein the first and second cleaning bars are controlled to provide their variable rotation speeds via electronic or mechanical settings to enable change in power consumption of the device.

23. A device according to claim 1, wherein the handle comprises a steering lock mechanism to constrain an angled steering joint into a fixed position when the handle is set in a vertical position.

24. A device according to claim 1, wherein the first wall portion has a first surface facing the first cleaning bar, the first surface being rearwardly inclined from the vertical line such that an upper end of the rearwardly inclined first surface is more proximate the rear end of the head cleaning unit than a lower end.

25. A device according to claim 24, wherein the first wall portion has a second surface facing the second cleaning bar, the second surface being partly rearwardly inclined from the vertical line such that an upper end of the rearwardly inclined part of the second surface is more proximate the rear end of the head cleaning unit than a lower end.

26. A device according to claim 1, wherein the first wall portion has a surface facing the second cleaning bar, the surface being partly rearwardly inclined from the vertical line such that an upper end of the rearwardly inclined part of the surface is more proximate the rear end of the head cleaning unit than a lower end.

27. A device according to claim 1, wherein the first cleaning bar rotates counterclockwise to cause debris to be urged over a front facing surface of the first wall portion.

28. A device according to claim 27, wherein the second cleaning bar rotates clockwise to cause debris to be urged over a rear facing surface of the second wall portion.

29. A device according to claim 1, wherein the second cleaning bar rotates clockwise to cause debris to be urged over a rear facing surface of the second wall portion.

30. A device according to claim 1, wherein the wall structure, the second cleaning bar and the debris collection reservoir are positioned relative to one another such that the second cleaning bar is interposed between the wall structure and the debris collection reservoir.

* * * * *